US007441584B2

(12) United States Patent
Cruse et al.

(10) Patent No.: US 7,441,584 B2
(45) Date of Patent: Oct. 28, 2008

(54) SEMI-SOLID MOLDING METHOD AND APPARATUS

(75) Inventors: Eric W. Cruse, Dayton, OH (US); Richard J. Kamm, Vandalia, OH (US); Larry T. Siefring, Troy, OH (US)

(73) Assignee: T.H.T Presses, Inc., Dayton, OH (US)

( * ) Notice: Subject to any disclaimer, the term of this patent is extended or adjusted under 35 U.S.C. 154(b) by 0 days.

(21) Appl. No.: 11/366,678

(22) Filed: Mar. 2, 2006

(65) Prior Publication Data

US 2007/0204968 A1 Sep. 6, 2007

(51) Int. Cl.
*B22D 17/12* (2006.01)
*B22D 23/00* (2006.01)
*B22D 25/00* (2006.01)

(52) U.S. Cl. ..... 164/113; 164/312; 164/900

(58) Field of Classification Search ..... 164/113, 164/312, 900

See application file for complete search history.

(56) References Cited

U.S. PATENT DOCUMENTS 5,490,427 A 2/1996 Yee et al.
5,564,312 A 10/1996 Brunman et al.
5,887,640 A * 3/1999 Brown et al. ..... 164/133
5,931,047 A 8/1999 Ellqvist et al.
6,250,174 B1 6/2001 Terada et al.
6,808,004 B2 10/2004 Kamm et al.
6,901,991 B2 6/2005 Kamm et al.
2003/0141033 A1 * 7/2003 Kamm et al. ..... 164/80
2003/0196775 A1 * 10/2003 Kamm et al. ..... 164/113
2004/0055726 A1 * 3/2004 Hong et al. ..... 164/113
2005/0279479 A1 * 12/2005 Han et al. ..... 164/71.1
2006/0151137 A1 * 7/2006 Kuroki et al. ..... 164/113

* cited by examiner

*Primary Examiner*—Kuang Lin
(74) *Attorney, Agent, or Firm*—Jacox, Meckstroth & Jenkins

(57) ABSTRACT

A metal alloy is heated to a molten state and then poured into a shallow shot chamber defined by a shot sleeve and a shot piston of a vertical die cast press. A homogenizing member having L-shape arms projecting outwardly from a vertical shaft is inserted into the molten metal, and the shaft and arms are simultaneously rotated and orbited by a six axes robot for moving more solidified semi-solid metal cooled by the shot sleeve and shot piston into a more liquified semi-solid metal within a central portion of the shot chamber to form a homogenizing slurry. The force required to move the homogenizing member is used to determine the solid fraction of the slurry and to stop the homogenizing process after a predetermined force is detected. A hydraulic cylinder actuates the piston to transfer the semi-solid slurry upwardly from the shot chamber into a die cavity.

6 Claims, 2 Drawing Sheets

SEMI-SOLID MOLDING METHOD AND APPARATUS

BACKGROUND OF THE INVENTION

This invention relates to semi-solid molding method and apparatus of the type disclosed in U.S. Pat. No. 6,808,004 and No. 6,901,991 which issued to the assignee of the present invention and the disclosures of which are herein incorporated by reference. The vertical die cast press and the method of using the press for semi-solid molding of metal alloys, as disclosed in these patents, utilizes a shallow shot chamber defined by a water cooled sleeve and a water cooled piston moveable vertically within the sleeve. The '991 patent also discloses the use of an extendable and retractable cooling pin within a central portion of the shot piston which is actuated or moved on its vertical axis by a hydraulic cylinder.

When the vertical die cast press is used fordeveloping a semi-solid slurry within the shot chamber, it is desirable for the slurry to have a uniform consistency or percentage of solids throughout the shot chamber before the slurry is injected or transferred upwardly into the cavity defined by the die set supported above the shot chamber. It is also desirable to minimize the time required to develop the uniform semi-solid slurry within the shot chamber in order to minimize the total cycle time required for molding the slurry into a high strength metal part such as an aluminum vehicle wheel.

As the molten metal within the shot chamber is cooled by the water cooled shot sleeve and the water cooled piston, the more solidified portion of the slurry adjacent the inner surface of the cooling shot sleeve produces a liner or "can" of more solidified metal adjacent the shot sleeve. As disclosed in the above- mentioned patents, this can is trapped by an annular entrapment recess above the shot chamber and opposing the can so that the can collapses and is prevented from flowing inwardly into the more liquid semi-solid metal as it is transferred into the die cavity. However, it has been found desirable to circulate at least some of the cooled pre-solidified metal adjacent the shot sleeve wall and adjacent the top surface of the piston with the more liquified metal so that the uniform slurry is produced more quickly and a greater percentage of the semi-solid metal within the shot chamber is transferred from the shot chamber into the die cavity. A thinner metal can also requires a lesser force to move the shot piston upwardly since there is less pre-solidified can metal to crush into the entrapment recess.

SUMMARY OF THE INVENTION

The present invention is directed to an improved method and apparatus for more efficiently producing high strength metal parts from a semi-solid metal and which provides all of the desirable advantages mentioned above. The method and apparatus especially provides for significantly reducing the cycle time for producing a metal part from a semi-solid metal in addition to providing for more uniformity of the grain structure throughout the part. In accordance with the illustrated embodiment of the invention, a vertical die cast press includes a water cooled shot sleeve surrounding a water cooled shot piston movable axially or vertically within the shot sleeve. The shot sleeve and shot piston cooperate to define a shot chamber, and molten metal, such as a molten aluminum alloy, is poured into the shot chamber. A homogenizing member is supported by a multiple axis robot and is inserted into the molten metal within the shot chamber and moved by the robot along an orbital and rotating path for moving the more solidified semi-solid metal adjacent the shot sleeve and shot piston into a more liquified semi-solid metal within a central portion of the shot chamber for more quickly producing a generally homogeneous semi-solid slurry.

The homogenizing member is retracted by the robot, and a die set is positioned over the shot chamber. The shot piston is then moved upwardly by a hydraulic cylinder to transfer the slurry from the shot chamber into a die cavity defined by the die set above the shot chamber. In the embodiment illustrated, the homogenizing member may include a vertical shaft supporting a plurality of radially outwardly projecting L-shaped arms. The arms are maintained under the surface of the semi-solid metal and slurry while the shaft and arms are simultaneously rotated and orbited about the shot chamber at a predetermined RPM.

Other features and advantages of the invention will be apparent from the following description, the accompanying drawings and the appended claims.

DESCRIPTION OF THE ILLUSTRATED EMBODIMENT

Figure 1:
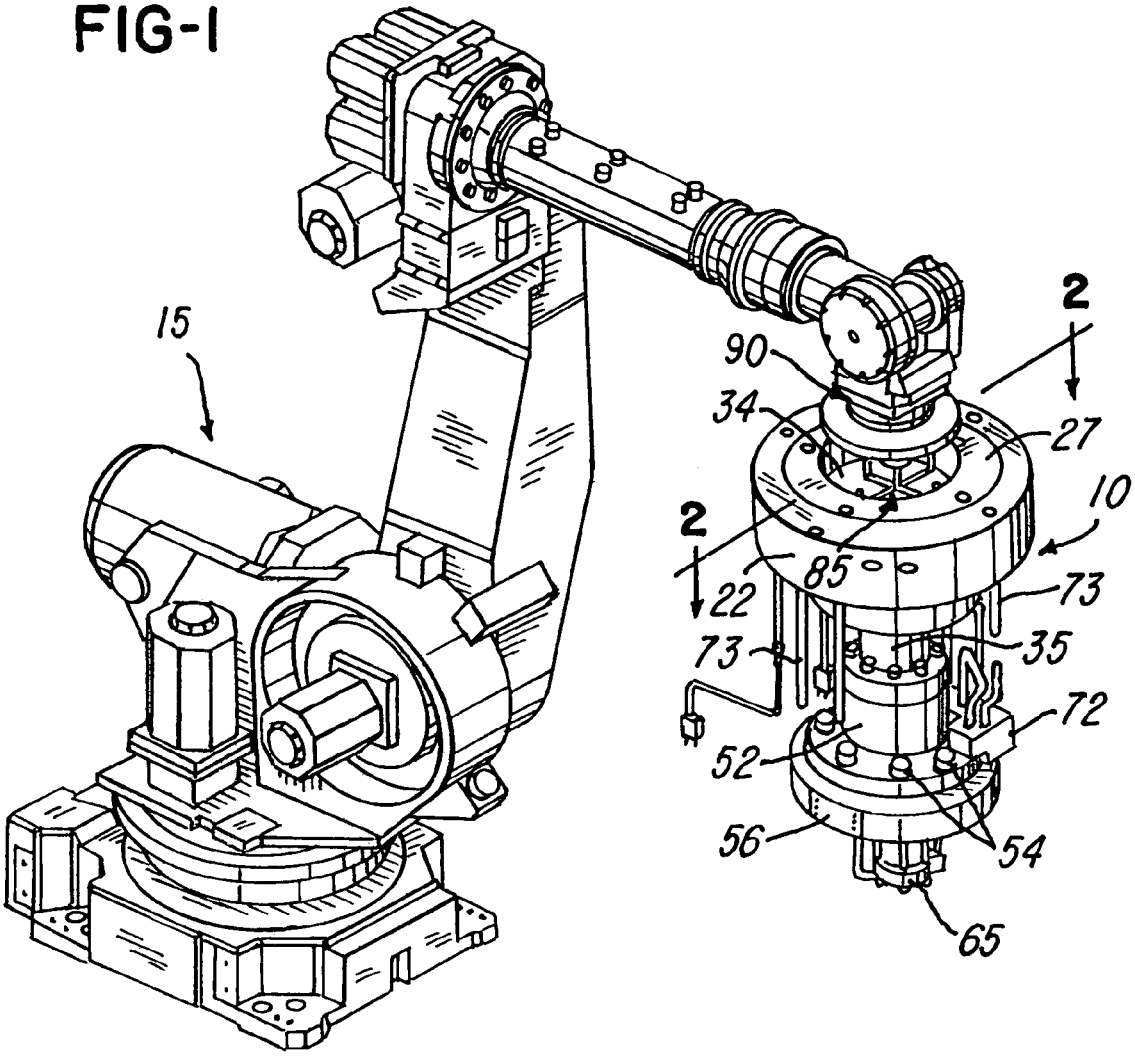
FIG. 1 is a perspective view of the assembled components of a vertical die cast press with a homogenizing member suspended within and orbited by the arm of a multiple axes programmable robot, in accordance with the invention.
Figure 2:
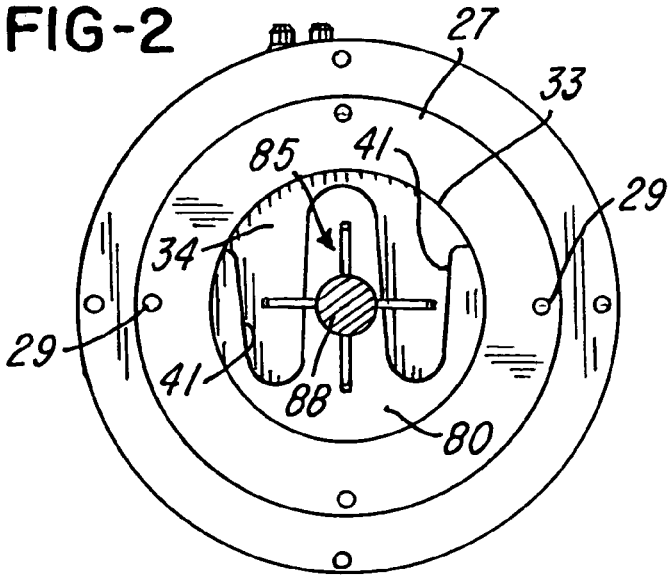
FIG. 2 is a plan view of the vertical die cast press and homogenizing member, taken generally on the line 2-2 of FIG. 1.
Figure 3:
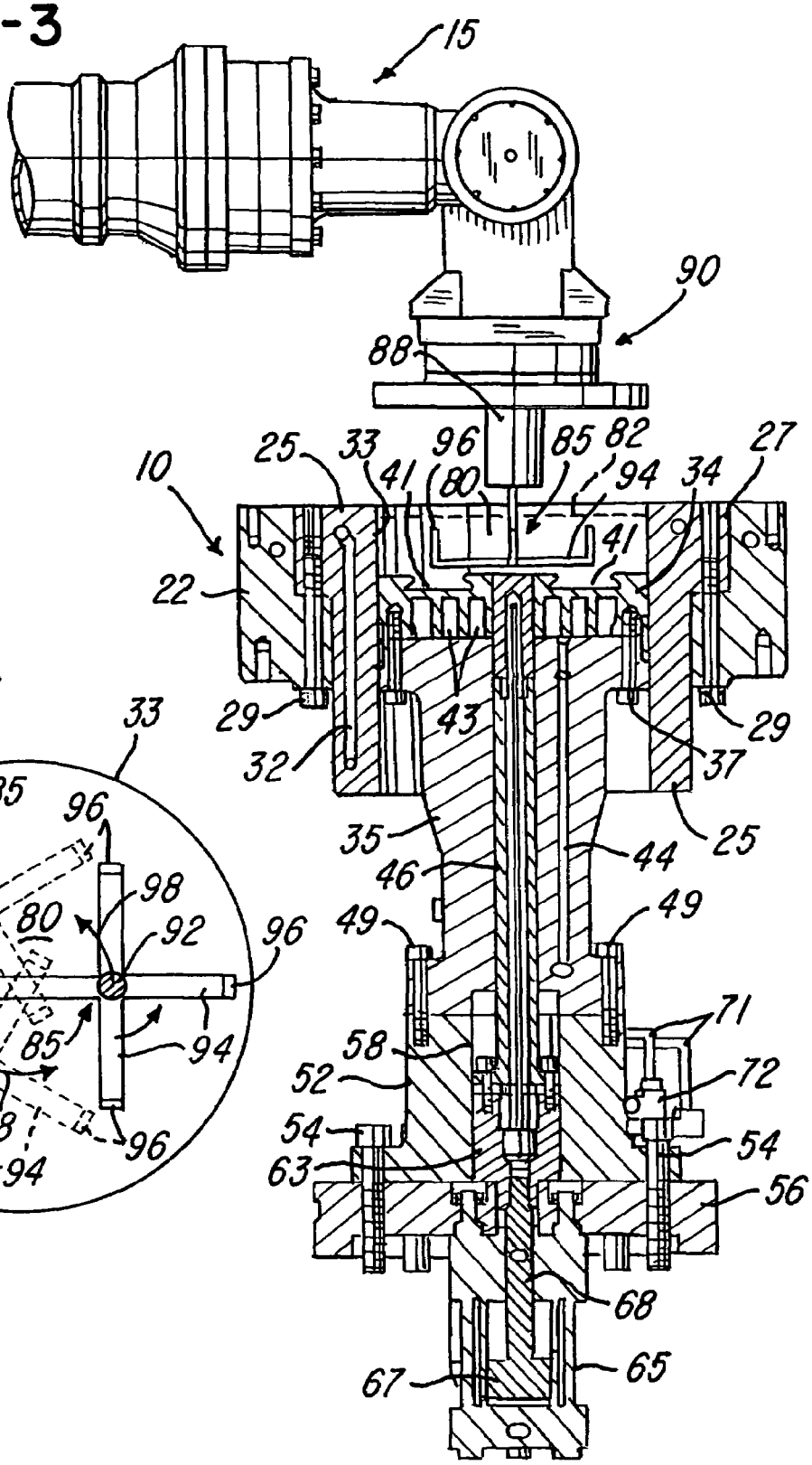
FIG. 3 is fragmentary elevational view of the robot arm and an elevational view of the homogenizing member with a vertical section of the assembled components of the vertical die cast press shown in FIG. 1.

FIGS. 1 & 3 illustrate the components of a vertical die cast press 10 which is constructed generally the same as the presses disclosed in above-mentioned U.S. Pat. No. 6,808,004 and No. 6,901,991 issued to the assignee of the present invention, the disclosures of which are herein incorporated by reference. FIG. 1 also illustrates a six axes industrial robot 15, for example, of the type produced by ASEA Brown Boveri AB and generally disclosed in its U.S. patents, for example, U.S. Pat. No. 5,564,312 and No. 5,931,047, the disclosures of which are herein incorporated by reference. The multiple axes robot 15 may also be of another form, for example, as produced by Fanuc Ltd. and disclosed in its U.S. patents, for example, U.S. Pat. No. 6,250,174, the disclosure of which is herein incorporated by reference. Such industrial robots commonly have six axes of movement or rotation, and the sixth axis is the axis of rotation of the output head or shaft which usually supports a tool.

Referring to FIG. 3, the vertical die cast press 10 includes a support ring or an annular support member 22 which supports a tubular or cylindrical shot sleeve 25 having an outwardly projecting upper flange 27 secured to the support member 22 by peripherally spaced screws 29. The shot sleeve 25 has circumferentially spaced and axially extending internal passages 32 through which a cooling fluid or water is circulated for cooling the sleeve. The shot sleeve 25 has an inner surface 33 which may be cylindrical or non-cylindrical and which slidably receives a mating head portion 34 of a shot piston 35, with the head portion being secured by circumferentially spaced screws 37. The top surface of the head portion 34 has a pair of dovetail slots 41, as disclosed in above-mentioned U.S. Pat. No. 6,901,991, and the bottom surface of the head portion 34 has interconnected concentric grooves 43 which receive a cooling fluid or water through a set of axially extending passages 44 within the shot piston 35.

As also disclosed in the above '991 Patent, the central portion of the shot piston 35 supports an axially extendable and retractable cooling pin 46, and the lower flange portion of the shot piston 35 is secured by circumferentially spaced screws 49 to an annular coupling member 52 having a bottom flange secured by circumferentially spaced screws 54 to a circular plate 56 mounted on the upper end of the piston of a hydraulically actuating injection cylinder. The annular coupling member 52 defines an internal cylindrical bore 58, and a bottom flange of the cooling pin 46 is secured by circumferentially spaced screws to a cylindrical bushing 63 which slides vertically within the bore 58. The cooling pin 46 is extended upwardly and retracted downwardly by a fluid actuating cylinder 65 including a piston 67 having a piston rod 68 with an upper end portion secured to the bushing 63. Cooling fluid or water is supplied to and circulated through the cooling passages 44 and through the passages within the cooling pin 46 by lines 71 connected to a fluid manifold block 72 mounted on the coupling member 52 for vertical movement with the shot piston 35. Cooling fluid or water is also circulated through the passages 32 within the shot sleeve 25 by lines 73 (FIG. 1) connected to the passages 32.

The internal surface 33 of the shot sleeve 25 and the top surface of the shot piston head portion 34 define a shot chamber 80 which preferably has a horizontal width substantially greater than its vertical depth, as shown in FIG. 3. For-example, the-shot chamber 80 may have a horizontal width-of ten inches and a vertical depth of three inches. A molten metal such as an aluminum A356 alloy, is poured into the shot chamber 80 on top of the piston head portion 34 and to a predetermined level forming a surface 82. A homogenizing head or member 85 is supported for rotation by the output shaft 88 on a head member 90 of the robot 15. The homogenizing member 85 includes a vertical shaft 92 (FIG. 4) which is attached to the rotary output shaft 88 of the robot 15. A plurality of four L-shaped arms 94 are secured to the shaft 92 and project radially outwardly with ninety degrees angular spacing between adjacent arms, and each arm 94 has a vertical tip or end portion 96.

Figure 4:
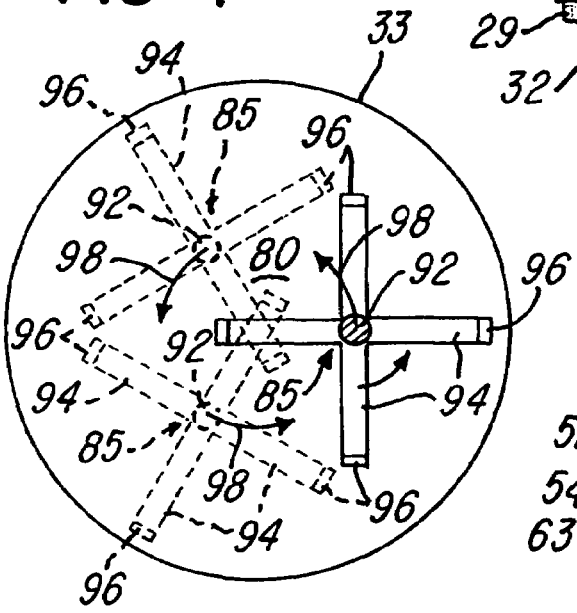
FIG. 4 is diagrammatic plan view of the vertical press shot chamber and showing the homogenizing member and its orbital and rotating path within the shot chamber.

The robot 15 is programmed to insert the homogenizing member 85 quickly into the molten metal or aluminum within the shot chamber 80 and then orbit the homogenizing member in an orbital path 98 shown in FIG. 4 while the homogenizing member 85 is also simultaneously rotated. By programming the rotation of the shaft 92 with the orbital movement of the robot output shaft 88, the end portions 96 of the arms move around the adjacent shot sleeve surface 33 while the molten metal is being cooled by the shot sleeve 25 and by the piston head member 34. As a result, the more solidified semi-solid metal adjacent the shot sleeve surface 33 and on top of the piston head member 34 is moved inwardly and upwardly into the more liquified semi-solid metal within a central portion of the shot chamber 80. The homogenizing member 85 thereby quickly produces a more homogenous semi-slurry within the shot chamber 80. For example, the homogenizing member 85 may be orbited within a range of forty to sixty RPM within a ten inch diameter shot chamber, and an orbital rotation of twenty-six to thirty revolutions is effective to produce a slurry having approximately forty percent solids or solid fraction. While the homogenizing member 85 is rotating and orbiting within the semi-solid metal in the shot chamber 80, the upper ends of the tip portions 96 of the arms 94 are maintained below the level 82 of the semi-solid metal, as shown in FIG. 3.

Preferably, the torque or forces and moments required to rotate and orbit the homogenizing member 85 are monitored or measured while the homogenizing member 85 is rotated and orbited within the semi-solid slurry. As the slurry thickens, the torque increases so that the torque corresponds to the solid fraction content of the slurry. When the torque reaches and maintains a predetermined level for a predetermined period of time, the homogenizing process is stopped. The homogenizing member 85 is then quickly retracted from the slurry by the robot 15 and moved laterally away from the shot sleeve 25. The shot sleeve 25 and the die set (not shown) may then be quickly brought together either by moving the shot sleeve to the die set or by moving the die set to the shot sleeve. The slurry is then injected upwardly into the die cavity by upward movement of the shot piston 35. The torque or forces and moments required to rotate and orbit the homogenizing member 85 may be monitored by sensing electrical current to the robot motors or by a load cell with strain gauges connected to rotational shafts of the robot. One form of six axis force sensor for a robot is disclosed in U.S. Pat. No. 5,490,427, the disclosure of which is herein incorporated by reference.

The programmed movement of the homogenizing head or member 85 within the molten metal in the shot chamber 80 along the rotational and orbital path shown in FIG. 4 provides desirable features and advantages. For example, the homogenizing member accelerates the development of a semi-solid slurry of substantially uniform consistency by taking advantage of the more rapid cooling at the inner surface 33 of the shot sleeve 25 and the top surface of the piston head portion 34. That is, the semi-solid metal is circulated from the higher cooling rate area to the lower cooling rate area to produce a more homogenous slurry in a shorter period of time. Minimizing the formation of the pre-solidified metal adjacent the inner surface 33 of the shot sleeve 25 also reduces the thickness of the can of pre-solidified metal at the sleeve wall surface 33, and thereby reduces the force required from the shot piston 35 to crush the pre-solidified metal can adjacent the shot sleeve wall surface.

A more homogenous slurry and a reduction of the formation of pre-solidified metal adjacent the inner surface of the shot sleeve and on the top surface of the shot piston, also provide for reducing the volume of molten metal that is poured into the shot chamber 80 to cast a part since a greater percentage of the poured volume of molten metal is used to produce the part. The development of the semi-solid slurry entirely within the shot chamber also contributes to minimizing the poured volume of molten metal to produce the part with the semi-solid slurry.

The use of the six axes programmable robot 15 for moving or simultaneously rotating and orbiting a homogenizing member also provides for adjustably selecting a path and speed which provide the desired semi-solid slurry with a uniform consistency of solids within a minimum time period. As mentioned above, by maintaining the upper ends of the end or tip portions 96 of the homogenizing member 85 below the surface 82 of the molten metal also maintains the metal at the surface more quiescent and minimizes the volume of molten metal that sticks or adheres to the arms 94. This minimizes the metal that must be removed from the homogenizing member between operating cycles. Thus the production efficiency of high strength metal parts, such as aluminum wheels, with the vertical die cast press 10 and the programmable movement of the homogenizing member 85 by the robot 15, is significantly increased. For example, twenty pounds of molten A356 aluminum alloy poured into a ten inch diameter shot chamber 80 to a depth of three inches may be homogenized to the desired percentage of solids in about twenty five seconds.

While the method and form of apparatus herein described constitutes a preferred embodiment of the invention, it is to be understood that the invention is not limited to the precise method and apparatus described, and that changes may be made therein without departing from the scope and spirit of the invention as defined in the appended claims.

What is claimed is:

1. A method for quickly and efficiently producing a high strength metal part within a die cavity defined by a die set above a vertical die cast press including a shot sleeve having a generally vertical axis and a shot piston movable axially within the shot sleeve by a power actuator, the shot sleeve and shot piston defining a shot chamber having a horizontal width greater than its vertical depth, the method comprising the steps of, positioning a multiple axis programmable robot adjacent the vertical die cast press with the robot having a rotatable and orbital output shaft with a generally vertical axis, connecting the output shaft of the robot to a generally vertical shaft of a depending homogenizing member having at least one arm generally parallel to the shot piston and a generally vertical outer end portion generally parallel to the shot sleeve heating a solid metal to form a liquified molten metal, pouring the molten metal into the shot chamber, lowering the homogenizing member with the robot downwardly into the molten metal within the shot chamber, cooling the shot sleeve and the shot piston for cooling the molten metal within the shot chamber to form semi-solid metal adjacent the shot sleeve and the shot piston, simultaneously rotating and orbiting the shaft and the homogenizing member with the robot in a horizontal orbital path while the molten metal is being cooled by the shot sleeve and the shot piston causing the arm and the end portion to move more solidified semi-solid metal adjacent the shot sleeve and adjacent the shot piston inwardly into more liquified semi-solid metal within a central portion of the shot chamber for quickly producing a homogenized semi-solid slurry of uniform consistency throughout the shot chamber, retracting the homogenizing member upwardly with the robot from the homogenized slurry within the shot chamber, positioning the die set above the shot chamber, moving the shot piston upwardly to transfer the homogenized semi-solid slurry from the shot chamber into the die cavity, and allowing the semi-solid slurry to solidify within the die cavity to form the high strength metal part.

2. A method as defined in claim 1 wherein the step of simultaneously rotating and orbiting the shaft of the homogenizing member is effective to sweep the arm across the top of the shot piston and to sweep the outer end portion of the arm adjacent the shot sleeve and then into the central portion of the shot chamber.

3. A method as defined in claim 1 wherein the homogenizing member includes a plurality of the arms angularly spaced around the shaft of the homogenizing member with each arm having an upwardly projecting outer end portion, and wherein the step of simultaneously rotating and orbiting the shaft is effective to sweep each arm adjacent the shot piston and to sweep each end portion adjacent the shot sleeve and then into the central portion of the shot chamber.

4. A method as defined in claim 1 and including the step of rotating and orbiting the homogenizing member until the semi-solid slurry has a substantially uniform consistency of about forty percent solids.

5. Apparatus for quickly and efficiently producing a high strength metal part within a die cavity defined by a die set, said apparatus comprising a vertical die cast press including a shot sleeve having a substantially vertical axis and enclosing a shot piston, with said shot sleeve and said shot piston defining a shot chamber having a horizontal width greater than its vertical depth, a power actuator connected to move said shot piston generally vertically on said axis within said shot sleeve, said shot sleeve and said shot piston having passages for receiving a cooling fluid for cooling a liquified molten metal poured into said shot chamber to form a semi-solid metal adjacent said shot sleeve and said shot piston, a multiple axis programmable robot positioned adjacent said press and having a rotatable and orbital output shaft with a generally vertical axis, a homogenizing member having a generally vertical shaft connected to said output shaft of said robot and projecting downwardly into the molten metal received within said shot chamber, said homogenizing member having at least one generally horizontal arm adjacent said shot piston and a generally vertical outer end portion adjacent said shot sleeve, said robot being programmed to rotate and simultaneously orbit said homogenizing member along a horizontal orbital path while the molten metal is being cooled by said shot sleeve and said shot piston for quickly moving more solidified semi-solid metal adjacent said shot sleeve and adjacent said shot piston inwardly into more liquified semi-solid metal within a central portion of said shot chamber for quickly producing a homogenized semi-solid slurry of uniform consistency throughout said shot chamber, and said power actuator being effective to move said shot piston upwardly to transfer the homogenized semi-solid slurry from said shot chamber into said die cavity of said die set where the semi-solid slurry solidifies to form the high strength metal part.

6. Apparatus as defined in claim 5 wherein said homogenizing member includes a plurality of said horizontal arms angularly spaced around said shaft of said homogenizing member and with each arm having an outer end portion projecting upwardly from said arm, and said robot being programmed to rotate and simultaneously orbit said shaft and said arms within the molten metal within said shot chamber to sweep each said arm adjacent said shot piston and to sweep said end portion of each said arm adjacent said shot sleeve and then move inwardly into said central portion of said shot chamber.

* * * * *